United States Patent [19]

Clelland

[11] 4,112,646

[45] Sep. 12, 1978

[54] PRE-CAST INSULATED WALL STRUCTURE

[76] Inventor: John J. Clelland, 449 Lombard St., Rochester, N.Y. 14606

[21] Appl. No.: 768,712

[22] Filed: Feb. 14, 1977

[51] Int. Cl.[2] ..... E04B 2/20; E04B 2/48

[52] U.S. Cl. ..... 52/372; 52/600

[58] Field of Search ..... 52/404, 371, 372, 373, 52/374, 375, 376, 378, 351, 381, 443, 454, 334, 597, 598, 599, 600, 405, 415, 451

[56] References Cited

U.S. PATENT DOCUMENTS

| | | | |
|---|---|---|---|
| 1,107,428 | 8/1914 | Likes | 52/432 |
| 1,390,951 | 9/1921 | Baughman | 52/372 |
| 1,428,147 | 9/1922 | Davis | 52/600 |
| 1,649,872 | 11/1927 | Swisher | 52/600 |
| 1,887,132 | 11/1932 | Houghton | 52/615 |
| 2,001,605 | 5/1935 | Foster | 52/600 |
| 3,435,580 | 4/1969 | Merrill | 52/576 |
| 3,484,990 | 12/1969 | Van Der Lely | 52/405 |
| 3,545,152 | 12/1970 | Knohl | 52/372 |

FOREIGN PATENT DOCUMENTS

| | | | |
|---|---|---|---|
| 1,289,703 | 9/1972 | United Kingdom | 52/376 |

*Primary Examiner*—John E. Murtagh

*Attorney, Agent, or Firm*—Clarence A. O'Brien; Harvey B. Jacobson

[57] ABSTRACT

A cementitious, fireproof, wall panel is provided including opposite side faces and pairs of remote upper and lower and opposite end marginal edge portions. At least one side face of the panel has a plurality of generally parallel elongated stud members partially imbedded therein, extending thereacross and projecting laterally outwardly therefrom. The spacing between those portions of adjacent stud members projecting outwardly from the one side face of the panel define outwardly opening channels and insulation panels are snugly received and seated within the channels with the outer surface portions of the insulation panels being generally flush with the outer faces of the stud members. The opposite side face of the wall panel is similarly provided with parallel studs and insulation panels and the latter studs are staggered relative to the studs on the remote side face of the panel. The panel is formed of cementitious material by pouring the cementitious material into a shallow mold after the alternate studs and insulation panels are arranged across its bottom and studs are imbedded in the upper surface of the cementitious material prior to its hardening with the corresponding insulation panels placed between the last mentioned studs.

3 Claims, 4 Drawing Figures

FIG. 1
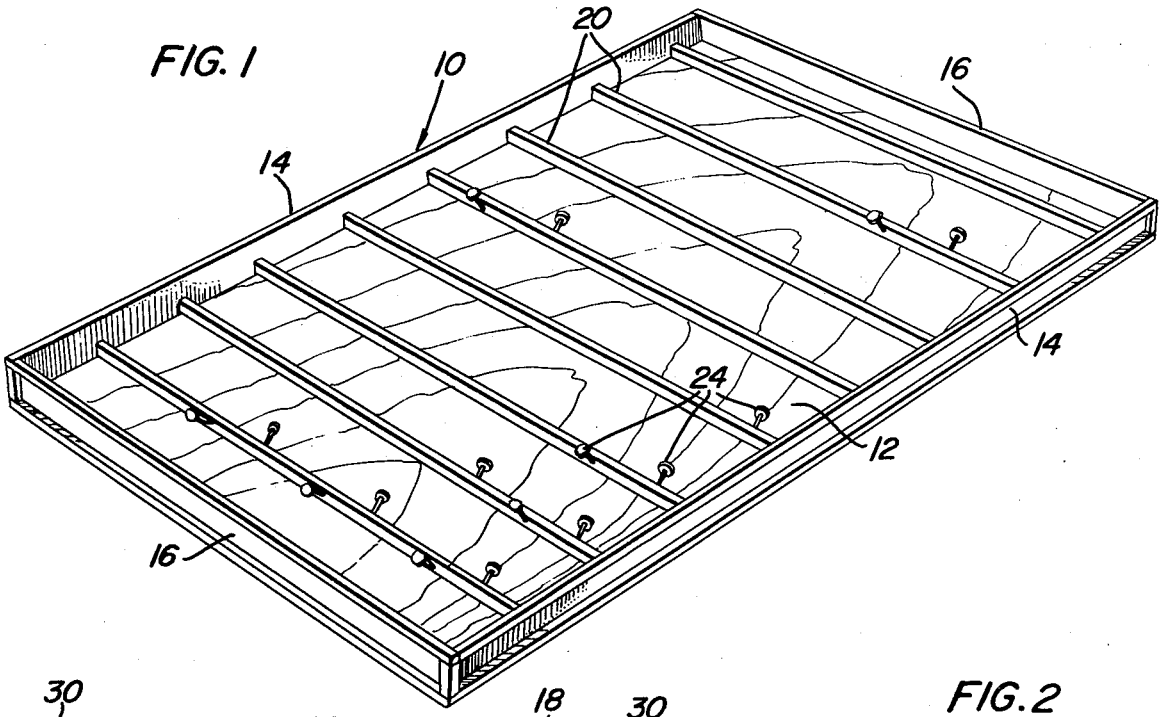
FIG. 2
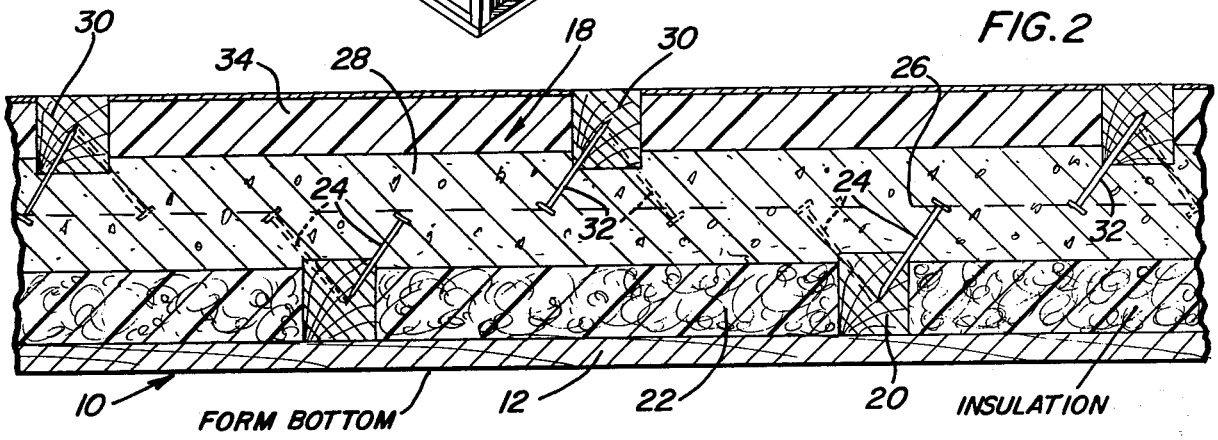
FIG. 3
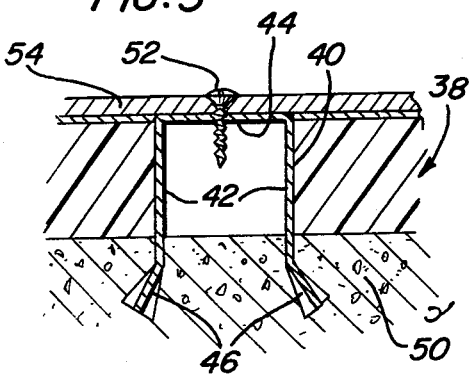
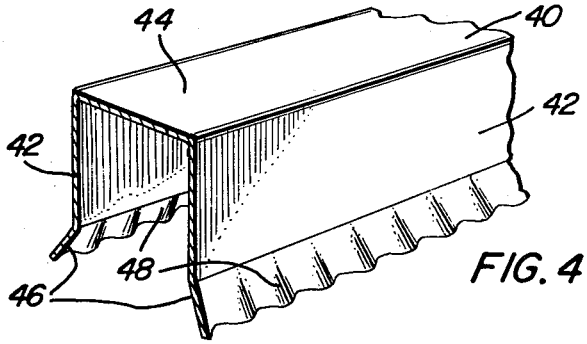
FIG. 4

PRE-CAST INSULATED WALL STRUCTURE

BACKGROUND OF THE INVENTION

Many different forms of pre-cast panels or slabs have been heretofore provided to form walls of building structures. Some of these pre-cast slabs or panels have included insulation and others have included structure cast in the panels for attaching both interior and exterior finishing panels thereto. However, a need exists for a pre-cast cementitious wall panel incuding integral studs on at least one side face thereof as well as insulation and which may be readily cast.

Examples of previously known pre-cast and otherwise constructed cementitious walls including some of the basic structural features of the instant invention are disclosed in U.S. Pat. Nos. 723,175, 984,517, 1,445,113, 1,617,033, 2,303,837, 3,466,825, 3,605,366, and 3,605,367.

BRIEF DESCRIPTION OF THE INVENTION

The cementitious wall panel of the instant invention may be readily pre-cast and, in its most comprehensive form, includes structural studs extending along the opposite side faces thereof between which insulation panels are disposed. The studs are imbedded in or otherwise securely anchored to the opposite side faces of the wall panel and may be utilized to secure exterior and interior finishing panels to the pre-cast wall panel.

An object of this invention is to provide and improved cementitious wall panel of the pre-cast type and which includes integral studs on at least one of the side faces thereof and which is substantially fireproof in construction.

Another object of this invention is to provide a pre-cast panel in accordance with the preceding object and which includes studs formed integrally with and projecting outwardly from both side faces of the panel.

Still another object of this invention is to provide a pre-cast panel including insulation panels disposed between the studs on the opposite side faces of the panel.

Yet another important object of this invention is to provide a pre-cast cementitious wall panel which may be readily formed by conventional casting procedures.

It is another object of this invention to provide a method of pre-casting cementitious wall panels with the finished panel including opposite side studs imbedded therein and having insulation panels disposed between adjacent studs.

Another very important object of this invention is to provide a method of casting panels in accordance with the immediately preceding object and which will enable the cementitious material used in casting the panel to cure over a long period of time without rapid loss of moisture.

A final object of this invention to be specifically enumerated herein is to provide a cementitious wall panel in accordance with the preceding objects and which will conform to conventional forms of manufacture, be of simple construction and easy to apply both exterior and interior finishing panels thereover.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE FIGURES

FIG. 1 is a perspective view of a mold utilized in constructing the cementitious wall panel of the instant invention and with a first set of the studs to be imbedded in the panel in position within the mold prior to the placement of insulation panels between the adjacent studs;

FIG. 2 is a fragmentary, sectional view of a cementitious wall panel constructed in accordance with the present invention prior to the panel being removed from the mold;

FIG. 3 is a fragmentary, sectional view illustrating the manner in which the wall panel may be formed through the utilization of metal studs imbedded in the panel; and FIG. 4 is a fragmentary, perspective view of the metal stud illustrated in FIG. 3.

DETAILED DESCRIPTION OF THE INVENTION

Referring now more specifically to the drawings, the numeral 10 generally designates a shallow horizontal mold including a bottom panel 12 and interconnected edge upstanding longitudinal side members 14 and end members 16. The corresponding ends of the side members 14 are interconnected by means of the corresponding end members 16 extending therebetween and the members 14 and 16 are suitably secured to the bottom panel 12 in any convenient manner (not shown).

The pre-cast cementitious panel of the instant invention is referred to in general by the reference numeral 18 and is formed by first placing a plurality of parallel studs 20 within the mold 10 on the bottom panel 12 with the studs 20 extending between the side members 14. The spacing between the studs may be conventional and a plurality of insulation panels 22 are then placed on the bottom panel 12 between adjacent studs 20 and the end members 16 and adjacent studs 20.

From FIG. 2 of the drawings it may be seen that the studs 20, prior to their being placed within the mold 10, have oppositely inclined nails 24 partially driven therein.

After the studs 20 and insulation panels 22 have been placed within the mold 10, wire reinforcing material 26 is placed over the studs 20 and insulation panels 22 and may be supported from the upper ends of the nails 24. Thereafter, fluent cementitious material 28 is poured into the mold over the studs 20, the insulation panels 22, the nails 24 and wire reinforcing material 26 to a level spaced above the wire reinforcing material 26 a distance generally equal to the spacing of the wire reinforcing material 26 above the insulation panels 22. Thereafter, a plurality of studs 30 having nails 32 partially driven thereinto are pressed downwardly into the fluent cementitious material 28 in a manner fully imbedding the exposed portions of the nails 32 in the material 28 as well as portions of the studs 30. Thereafter, additional insulation panels 34 are placed between adjacent studs 30 over the material 28 and between the end members 16 and the adjacent studs 30. Accordingly, the cementitious material 28 is substantially fully sandwiched between the studs 20 and 30 and the insulation panels 22 and 34 and is thereafter allowed to harden. Of course, inasmuch as the material 28 is completely enclosed within the mold 10 between the studs 20 and 30 and the insulation panels 32 and 34, curing of the cementitious material 28 without rapid loss of moisture is enabled.

Therefore, an extremely strong pre-cast panel is formed. Of course, after the cementitious material 28 has hardened, the completed panel 18 may be removed from the mold 16.

Inasmuch as the studs 20, as well as the studs 30, are constructed of wood and the insulation panels 22 would usually be more compressible than the studs 20, even though the upper surfaces of the insulation panels 22 and the studs 20 may be substantially flush prior to the cementitious material 28 being poured into the mold 10, the studs 20 may project upwardly above the upper surfaces of the insulation panels 22 and actually be at least somewhat imbedded in the cementitious material 28.

With attention now invited more specifically to FIG. 3 of the drawings there may be seen a modified form of panel referred to in general by the reference numeral 38 utilizing generally channel-shaped metal studs 40 in lieu of wooden studs, such as the studs 30. The channel-shaped studs 40 include opposite side flanges 42 interconnected along one pair of corresponding marginal edge portions by means of an integral bight portion 44 extending therebetween and the marginal edges of the flanges 42 remote from the bight portion 44 are oppositely outwardly flared as at 46 and corrugated as at 48, see FIG. 4. Of course, the studs 40 are securely imbedded in the cementitious material 50 of the panel 38. In addition, self-tapping metal screws 52 may be utilized to secure an interior finishing panel 54 over the bight portions 44 of the studs 40.

It is to be noted that the pre-cast panel may be provided with wooden studs on both sides, metal studs on both sides, or wood studs on one and metal studs on the other side. In any event, exterior finishing panels may be readily secured over the studs 20 in the same manner in which the interior finishing panel 54 is secured over the studs 40 and interior finishing panels may be secured over the inner side studs in a like manner.

Also, any suitable anchor plates or other anchor structure may be imbedded in the cementitious material of the wall panel to enable adjacent wall panels to be anchored together to form the desired wall or building corner structure. Further, one longitudinal marginal edge of the wall panel may have a header beam or plate imbedded therein anchored thereto.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A panel for use as a building unit and including large, planar, spaced side faces interconnected by parallel end edges and parallel side edges, said panel comprising a continuous core of reinforced, monolithic cementitious material having side faces spaced inwardly from the side faces of the panel, a plurality of stud members partially embedded in each side surface of the cementitious core, said stud members being parallel to each other, laterally spaced from each other, extending from side edge to side edge of the panel, having the outer surface thereof substantially flush with the side faces of the panel, and having a major portion of their thickness projecting from the core, means on each stud member embedded in the core to lock the stud members thereto, insulation panels disposed against each side face of the panel and between adjacent stud members, said insulation panels completely filling the space between adjacent stud members with the outer side faces thereof substantially flush with the side faces of the panel and the outer surfaces of the stud members, said stud members and insulation panels being assembled with core when the cementitious material is fluent for securing the stud members to the core with the insulation panels slowing moisture flow from the cementitious material while it hardens thereby controlling the curing time and strength of the core, said stud members being consturcted of material penetrable by fasteners to facilitate attachment of a finish panel to the planar side faces of the panel.

2. The structure as defined in claim 1 wherein each of said stud members is in the form of a channel-shaped metal member having parallel legs embedded in the cementitious core and a bight portion interconnecting the legs and defining the outer surface of the stud member to which a finish panel may be attached, said means on the stud member embedded in the core including outwardly diverging flanges on the free ends of the parallel legs of the channel-shaped stud member, each of said flanges being laterally corrugated from a shallow corrugation where the flange joins with the leg to a deeper corrugation at the free edge of the flange for rigidly securing the stud to the core.

3. The structure as defined in claim 1 wherein each of said stud members is in the form of a wood member having a planar outer surface defining a portion of the side surface of the panel for receiving fasteners to secure a finish panel thereto, said means on the stud members embedded in the core including a plurality of nails driven into the inner portion of each of the stud members, said nails on each stud member being angulated in relation to each other with the heads thereof remote from the stud member for rigidly securing the stud member to the core.

* * * * *